United States Patent [19]

Martin

[11] Patent Number: 4,802,575

[45] Date of Patent: Feb. 7, 1989

[54] FOOD STORE COUPON ORGANIZER

[76] Inventor: Dorothy B. Martin, 1205 E. Ocean Blvd., Long Beach, Calif. 90802

[21] Appl. No.: 54,200

[22] Filed: May 26, 1987

[51] Int. Cl.[4] ..... B65D 85/00; A45G 11/00

[52] U.S. Cl. ..... 206/232; 206/214; 206/425; 402/79; 40/384; 40/404; 40/405

[58] Field of Search ..... 206/223, 232, 425, 214, 206/459; 150/147; 40/384, 404, 405; 283/51, 52; 402/79

[56] References Cited

U.S. PATENT DOCUMENTS

| | | | |
|---|---|---|---|
| 508,394 | 11/1893 | Andrews | 206/425 |
| 1,752,300 | 4/1930 | Hutchings | 40/405 X |
| 3,837,104 | 9/1974 | Brotschi | 40/404 |
| 3,911,605 | 10/1975 | Morhack | 40/404 |
| 4,004,690 | 1/1977 | Giarritta | 206/425 |
| 4,206,055 | 4/1981 | Slaybaugh | 206/425 X |
| 4,244,660 | 1/1981 | Aronson | 402/79 |
| 4,255,872 | 3/1981 | Williams, Sr. | 206/232 X |
| 4,312,393 | 1/1982 | Green | 206/425 X |
| 4,450,994 | 5/1984 | Holland | 206/425 X |
| 4,463,848 | 8/1984 | Parker | 206/425 X |
| 4,572,547 | 2/1986 | Phillips | 206/459 X |
| 4,591,054 | 5/1986 | Blossom | 206/459 X |

FOREIGN PATENT DOCUMENTS

| | | | |
|---|---|---|---|
| 775612 | 1/1935 | France | 206/425 |
| 2248693 | 5/1975 | France | 40/405 |
| 88032 | 7/1956 | Norway | 206/425 |
| 8404279 | 11/1984 | PCT Int'l Appl. | 206/425 |
| 149379 | 8/1920 | United Kingdom | 40/384 |

*Primary Examiner*—William Price

*Attorney, Agent, or Firm*—Fulwider, Patton Rieber, Lee & Utecht

[57] ABSTRACT

A coupon organizing system having a carrying case sized to receive a coupon filing assembly, a plurality of shopping tools and a sorter. The filing assembly includes a plurality of pages having first indicia means and a plurality of substantially overlapping and staggered pockets formed therein. Each pocket is defined by a pair of walls of unequal heights and has a lip formed adjacent the top of one wall and second indicia means mounted thereto. A method for sorting and retrieval of coupons according to product type and expiration date is provided.

3 Claims, 2 Drawing Sheets

FOOD STORE COUPON ORGANIZER

BACKGROUND OF THE INVENTION

This invention relates generally to improvements in methods and apparatus for organizing coupons and, more particularly, to a new and improved organizing system and apparatus for facilitating the selection of food coupons according to the expiration date and type of merchandise.

During recent decades, the cost of living has been constantly on the increase. As with other consumer items, the cost of food products has also increased. This fact and the fact that food is one of the necessities of life has placed great emphasis upon cost savings in the purchase of food. This emphasis has resulted in the popularity of food coupons which are slips of paper redeemed at a food market at the time of purchase, to reduce the purchase price of the food item. These coupons are often used by the retailer or manufacturer as a marketing tool to increase the sales of designated merchandise by discounting the purchase price. The manufacturer may be introducing a new product on the market or trying to increase the sales of a particular item which has been overstocked. In addition, retailers often use coupons to attract buyers to their markets and consequently increase the sales of other non-discounted items.

Expiration dates are usually placed on the coupons to temporarily limit the discount offer. Some reasons for the use of expiration dates include an attempt to correlate the demand of the item to the supply on hand of the particular merchandise and/or to raise the price of the item after the consumers have been introduced to a new product.

Coupons are frequently distributed to the public through magazines or newspapers and local newspapers often have specific days of the week or sections of the newspaper which have a relatively large number of coupons. Because of the variety and number of coupons available to be collected by the consumer, the consumer frequently finds it difficult to organize the coupons for quick reference according to their particular expiration dates, product types or retailer. As a result, the consumer may fail to use the particular coupon before it expires.

For these reasons, consumers who use coupons have long recognized the need for an improved coupon organizing system that enables a quick reference to and selection of food coupons which have been accumulated by the consumer. The present invention fulfills all of these needs.

SUMMARY OF THE INVENTION

Briefly and in general terms, the present invention provides a new and improved food coupon organizing system embodying novel methods and apparatus for accurately and reliably organizing accumulated food coupons for rapid retrieval by the consumer. Basically, the coupon organizing system of the present invention is directed to a system which includes a coupon filing assembly and a plurality of shopping tools and coupon sorters disposed within a carrying case or binder.

More particularly, the coupon filing assembly of the present invention includes a plurality of category pages releasably attached to the carrying case. The pages each include a plurality of indicia means to allow sorting and selection of coupons on the basis of various criteria. A first indicia means extends from each category page to distinguish that page from another adjacent page and to provide a tab for manipulation by the users fingers. Each category page contains a plurality of coupon pockets substantially overlapping and staggered relative to each other across the page to enable quick access to each pocket. In one preferred form of the invention, there are at least fourteen coupon pockets for retaining and segregating monthly expiring coupons, non-expiring coupons and non-sorted coupons. Each pocket may consist of a pair of walls of unequal heights, joined to each along a bottom edge and having an upper lip along a front wall to facilitate separation of two walls and insertion of coupons therebetween. A second indicia means extends from each coupon pocket. A third indicia means is mounted on each category page to identify the goods to which the coupons stored on that particular page relate.

A plurality of shopping tools, mounted to the carrying case, are also provided and include means for releasably attaching the necessary shopping tools to the carrying case. The inclusion of these items, e.g. paper pads, a writing instrument, a currency holder, a checkbook holder, a calculator, a key ring holder and scissors, allows the consumer to sort, organize and use the coupons while shopping without the necessity of carrying anything other than the coupon organizer of the present invention.

Furthermore, to organize the coupons for distribution within the appropriate coupon pocket, the coupon organizing system of the present invention may also include a first sorter to sort the coupons according to the type of merchandise and a second sorter to chronologically separate the coupons according to their expiration dates. Each sorter may comprise a sorter back wall and a staggered plurality of divider walls pivotally mounted to the back wall along a divider wall bottom edge. Alternatively, staggered pockets may be used, e.g. similar to those pockets on the category pages as earlier described. Insertion of the coupons into their appropriate coupon pocket indexes and allows rapid retrieval of the food coupons when desired. The sorting according to the expiration date also prevents the consumer from inadvertently allowing the coupons to lapse and prevents the embarassment of trying to redeem an expired coupon. Hence, the system of the present invention minimizes the time lost in retrieving the desired food coupons and enables the consumer to best utilize the coupons collected.

Other features and advantages of the present invention will become apparent from the following detailed description, taken in conjunction with the accompanying drawings, which illustrate by way of example, the principles of the invention.

DETAILED DESCRIPTION OF THE INVENTION

Figure 2:
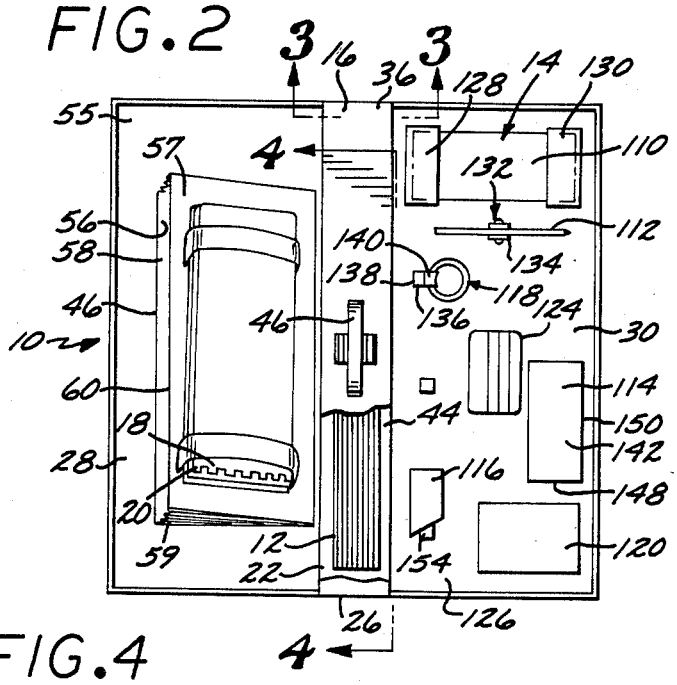
FIG. 2 is a fragmentary, plan view of the carrying case shown in FIG. 1.
Figure 4:
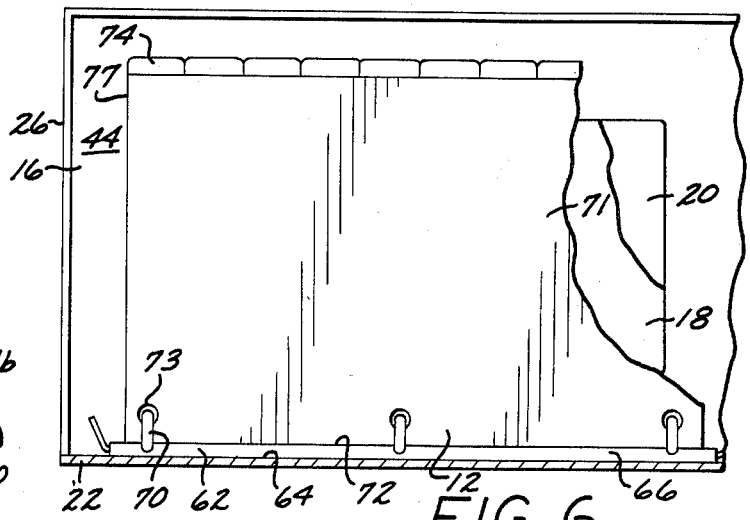
FIG. 4 is a fragmentary, longitudinal, sectional view of the carrying case of the present invention substantially taken along the line 4—4 of FIG. 2.
Figure 5:
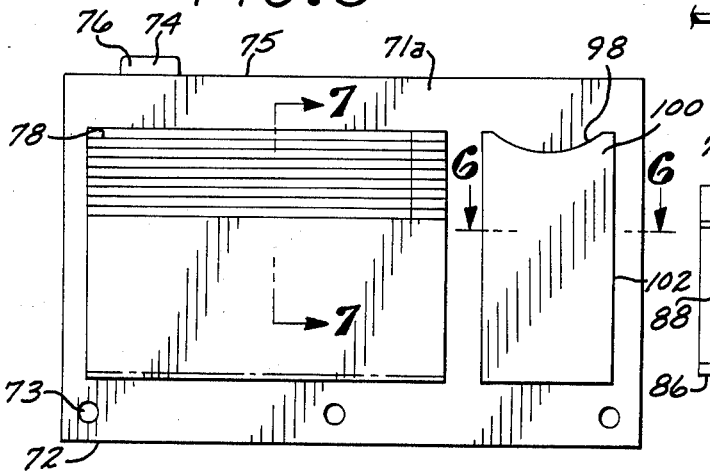
FIG. 5 is a side plan view of a category pocket page of the present invention.
Figure 9:
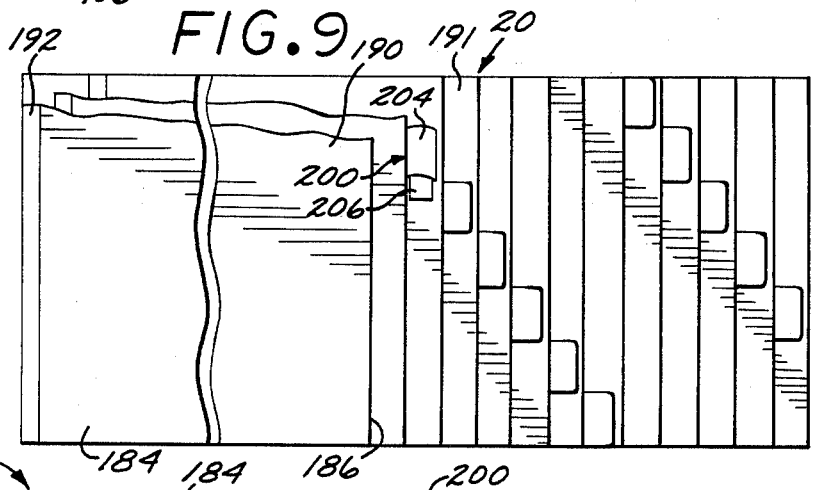
FIG. 9 is fragmentary top view of the second sorter of the present invention.
Figure 10:
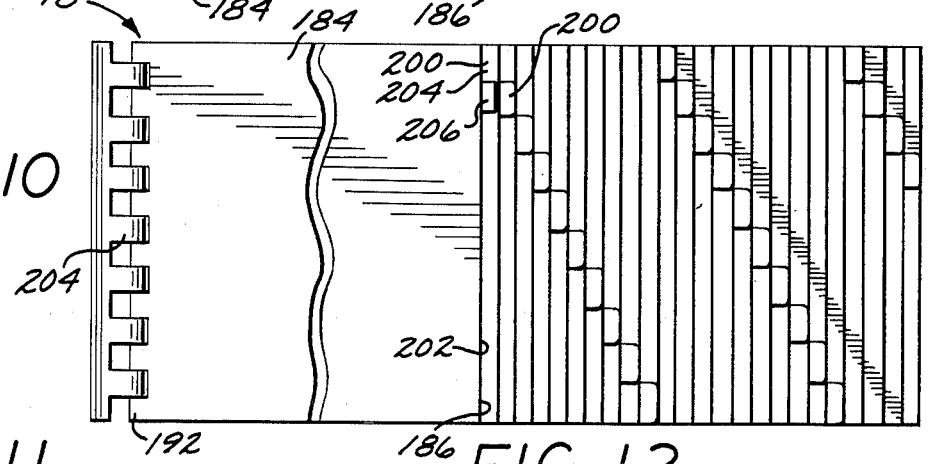
FIG. 10 is a fragmentary top view of the first sorter of the present invention.

As shown in FIG. 2 of the exemplary drawings, the coupon organizing system of the present invention, generally referred to by the numeral 10, includes a coupon filing assembly 12 and a plurality of shopping tools 14, disposed within a carrying case or binder 16. As best shown in FIGS. 10 and 9, the system 10 may include a first sorter 18 and a second sorter 20, respectively, to facilitate the separation and organization of the coupons for placement into the filing assembly 12 as best shown in FIGS. 2, 4 and 5.

Figure 1:
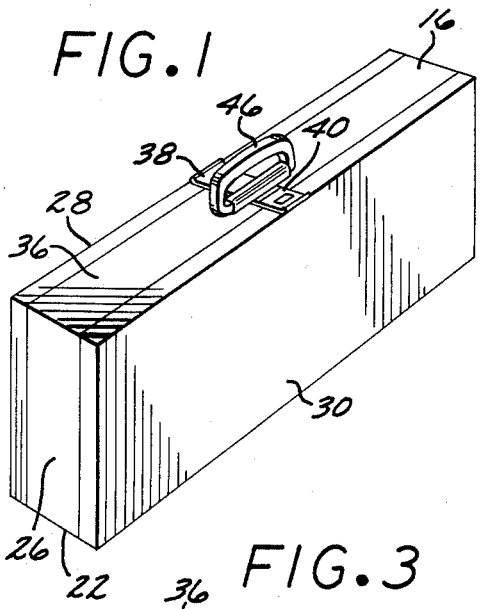
FIG. 1 is a perspective view of the carrying case of the present invention.
Figure 3:
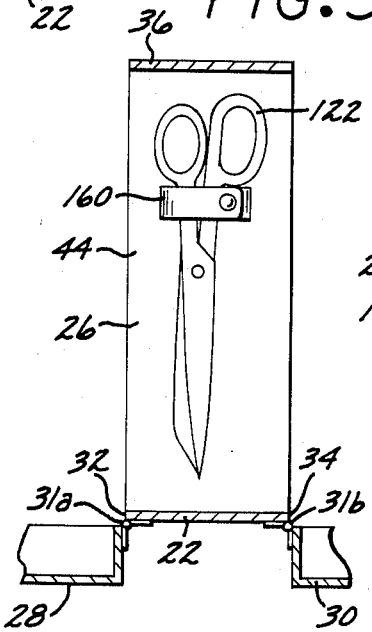
FIG. 3 is a transverse sectional view substantially taken along the line 3—3 of FIG. 2.

As best shown in FIGS. 1, 2 and 3, the coupon organizer of the present invention 10 includes a carry case 16, sized to receive the coupon filing assembly 12, and having a case bottom wall 22. As an example of one of the means by which the invention may be implemented, one preferred form of the invention may use a bottom wall which is about three and one-half inches wide (i.e. the dimension along a long transverse axis) and about fourteen and one-half inches long (i.e. the dimension along the longitudinal axis). Extending upward from the bottom wall along each longitudinal end 24 are upward extending side walls 26. Referring to FIG. 3, a front wall 28 and back wall 30 are pivotally mounted by hinges 31*a* and 31*b* to the bottom wall 22 adjacent bottom edges 32 and 34 of the front wall 28 and the back wall 30, respectively, so that they can pivot from a first or closed position, as best shown in FIG. 1, to a second or open position relative for the bottom wall 22, as best shown in FIGS. 2 and 3. The side, front and back walls extend upward to terminate at a top wall 36. Referring to FIG. 1, the front and back walls 28 and 30, respectively, are releasably attached to the top wall 36 by latch mechanisms 38 and 40, respectively. As best shown in FIG. 2, these latch mechanisms allow access to the interior 44 of the case 16 to gain access to the filing assembly 12 and the plurality of shopping tools 14 disposed therein. A handle 46 is pivotally mounted atop the top wall 36. The carrying case 16 may be sized to fit into the upper seat area of a typical supermarket shopping cart.

For convenience and security in carrying the case, a strap having a distal end and a proximal end may extend from the carrying case 16. More particularly, the distal end may be attached to the carrying case and a "C" clip or clasp disposed at the distal end of the strap releasably secures the case 16 to the shopping cart to prevent theft of the carrying case therefrom.

Referring to FIG. 2, disposed on an inside surface 55 of the carrying case 16 is an unclipped coupon holding pocket 56. The unclipped coupon holding pocket 56 may be defined by a front pocket wall or flap 57 which is pivotally mounted about a longitudinal axis of the case to allow outward movement relative a back pocket wall 58. The carrying case front wall 28 or back wall 30 may be used as the holding pocket back wall 58. The pocket front wall 57 may be about seven inches along the long transverse axis and about twelve inches along the longitudinal axis of the case. Accordian gussets 59 may be interposed between the front wall 57 and the back wall 58. A resealable top 60 prevents the unwanted disbursal of the unclipped coupons after their insertion within the holding pocket 56.

Referring to FIG. 4, an attachment assembly 62 mounted on the inside surface 64 of the carrying case 16 for selectively and releasably mounting of the filing assembly 12 to the interior 44 of the carrying case 16. The attachment assembly 62 of the present invention may include a spine 66 mounted to the inside surface 62 by conventional attachment means (not shown), e.g. bolts, screws or rivets. In the preferred form, the attachment assembly 62 may be in the form of a conventional three-ring binder assembly of the type having a plurality of concentric rings 70, which selectively open to retain pages thereon.

Referring more particularly to FIG. 4, the coupon filing assembly 12 includes a plurality of category pocket pages 71. The category pocket page 71 has a first wall 71*a* releasably attached to the attachment assembly 62 adjacent a category pocket page bottom edge 72. For the purposes of illustration, the category pocket page 71 may be about eight and one-half inches along a long transverse axis, i.e. "width" and about eleven inches along a longitudinal axis, i.e. "long". Plural apertures 73 are formed adjacent the page bottom edge 72 to cooperate with the concentric rings 70 of the attachment assembly 62. This feature of the invention allows for the easy insertion, sequencing or removal of category pocket pages 71.

Referring to FIG. 5, each category pocket page 71 includes a first indicia 74. Extending upward from a top edge 75 opposite the bottom edge 72. The first indicia 74 distinguishes each category pocket page 71 from one another by indicating the merchandise or product to which each coupon stored on that particular page. In addition, the identifying indicia 74 provides a protrusion or finger tab 76 to allow the operator to manipulate the category pages 71 and quickly go to the desired category page. For the convenience of the operator, the identifying indicia 74 may include pre-printed labels for insertion into the finger tabs 76, e.g. "household cleaners", to clearly identify and distinguish each category pocket page. Different colors or symbols may also be used to help distinguish between the plurality of first indicia 74. Several blank labels may be provided for the operator's own category designation. Perforations may be provided to separate individual labels from a sheet of these pre-printed labels. In one preferred form, these labels may be about two inches long by about nine-thirty-secondths of an inch wide. As best shown in FIG. 4, these first identifying indicia 74 may be staggered at various locations along the top edge 75 relative a first side edge 77 to facilitate the reading, identifying and accessing of the particular category pocket page desired.

Figure 7:
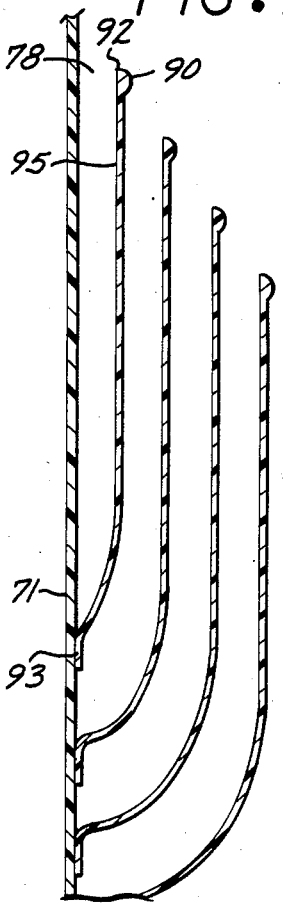
FIG. 7 is a fragmentary, transverse sectional view of the category pocket page of the present invention, substantially taken along the line 7—7 of FIG. 5.

Referring to FIGS. 5 and 7, each category pocket page 71 includes a plurality of first or coupon pockets 78. In the preferred form, there are a total of fourteen coupon pockets 78, the first twelve coupon pockets corresponding to each month of the year, another pocket for coupons which will expire during the next year and a last coupon pocket to retain coupons having no expiration date at all.

Figure 6:
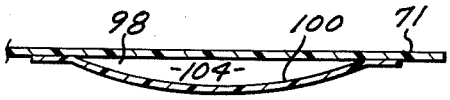
FIG. 6 is a fragmentary, sectional top view of the category index pocket of the present invention substantially taken along the line 6—6 of FIG. 5.
Figure 6A:
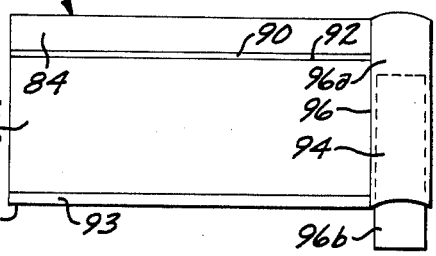
FIG. 6*a* is an enlarged elevational view of the coupon pocket of the present invention.

Each of these first pockets 78 extend longitudinally along the category pocket page 71 from the first side edge 77. As best shown in FIG. 6*a*, each coupon pocket may be defined by a back wall 84 joined along a bottom edge 86 to a front wall 88. In one preferred embodiment, the back wall 84 may be about two and one-quarter inches by about seven inches. In a preferred form of the invention, each separate category pocket 78 has a front wall 88 and the back wall 84 of unequal heights to ease the insertion and removal of coupons therefrom and thus have a portion not overlapped by the other wall. In one embodiment of the invention, the front wall 88 may be about one-sixteenth of an inch shorter along the long transverse axis than the back wall 84.

As best shown in FIGS. 6A and 7, to facilitate insertion and withdrawal of coupons from the coupon pocket 78, the front wall may have a heat formed lip 90 along a front wall top edge 92 and heat formed portion 93 upward along the back wall from the bottom edge 86. The heat formed portion 93 may extend upwards for about five-eighths of an inch.

Referring to FIG. 6*a* a second identifying indicia 94 may extend outward from a second side edge 96 of the coupon pocket to distinguish between and provide a finger tab for each individual coupon pocket 78. As with the first indicia means, the second indicia means may include a protrusion or tab member 96*a*, sized to receive a label 96*b* therein. For the convenience of the operator, the labels may be pre-printed with the month and/or other identifying symbols, colors, numbers, etc.

As best shown in FIG. 5, the plurality of coupon pockets 78 are mounted to the pocket page 71 in a substantially overlapping or staggered manner upward from the bottom edge 72 across the category pocket page 71 to facilitate access to each pocket. In the preferred form, each successive pocket 78 is staggered about five-sixteenths of an inch relative the adjacent coupon pocket 78. Alternatively, as best shown in FIG. 7, the coupon pockets 78 may be defined by a plurality of substantially overlapping divider walls 95 mounted directly to the first wall 71*a* of the category page 71. By this alternative construction, individual pockets need not be separately constructed, reducing the amount of material needed to construct the pockets.

Figure 11:
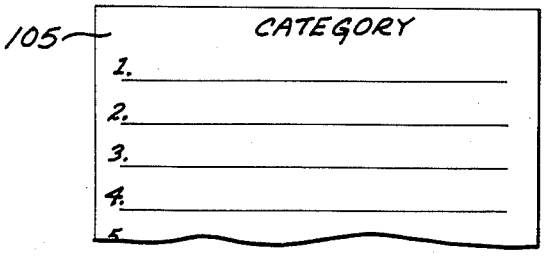
FIG. 11 is a fragmentary front view of the category index card of the present invention.
Figure 12:
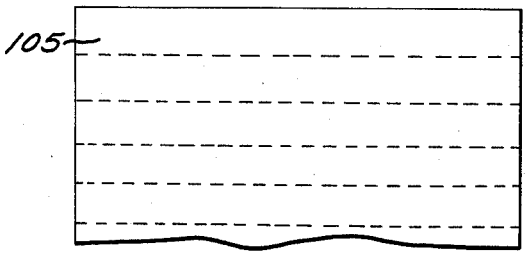
FIG. 12 is a fragmentary back view of the category index card of the present invention.

Referring to FIG. 5, positioned adjacent the coupon pockets 78 is a category index pocket 98. The category index pocket may comprise a sheet of material 100, joined to the category page 71 along three edges 102 to define a space 104 therebetween. The index pocket 98 may be formed of plastic or other transparent material. Category index cards 105 are disposed within the space 104 and retained therein. Pre-printed labels may be used to list the items considered within the identified category on the particular pocket page 71 in question. As best shown in FIGS. 11 and 12 for the purposes of illustration, three-by-five cards may be lined front and back for written description of the items considered within each category.

Figure 8:
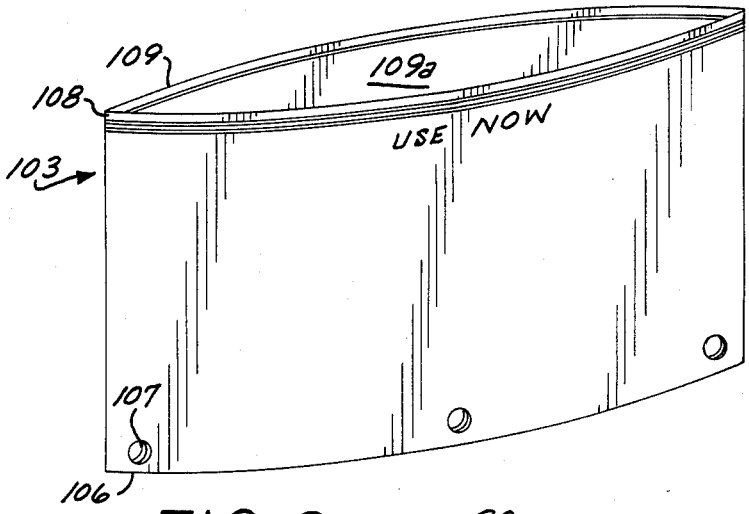
FIG. 8 is a perspective view of the "use now" pocket of the present invention.

Referring to FIG. 8, there is shown the "use now" bag 103 of the present invention. This feature is extremely useful in preventing the expiration of a desireable coupon before it can be used for the purchase of merchandise. Positioned adjacent a first edge 106 are a plurality of apertures 107 to cooperate with the attachment assembly 62 e.g. with the concentric rings 70. A zip-lock assembly 108 may be disposed adjacent a second edge 109 opposite the first edge 106. This zip-lock assembly allows selective access to the interior 109*a* of the bag 103 while preventing the undesired disbursal of items placed therein.

Referring to FIG. 2, a plurality of various shopping tools 14 may be disposed on an inside surface of the back wall 30 of the carrying case 16. As a result, the operator need only carry the coupon organizing system 10 of the present invention when shopping, thus dramatically decreasing the clutter and inconvenience associated with redeeming coupons. This plurality of shopping tools may include, for example, a paper pad 110, a writing instrument 112, a currency holder 114, a checkbook holder (not shown), a key ring holder 118, and a calculator 120. Referring to FIG. 3, a pair of scissors 122 may be mounted to the side wall 26 of the carrying case 16. If necessary, additional pockets (not shown) may be included within the case 16.

More particularly, as best shown in FIG. 2, a paper pad 110 may be mounted within the carrying case 16. Two strips 128 and 130 are mounted on the carrying case back wall 30 and cooperate with the wall to retain the paper pad 110 therebetween. Mounted adjacent the paper pad 110 is a first clip 132 to releasably engage the writing instrument 112. The first clip 132 may be a "U" or "C" shaped clip to grasp the writing utensil between two prongs 134. A second clip 136 has a back portion 138 mounted to the carrying case 16 and a front portion 140 for releasably attaching the operator's car keys to the carrying case 16. The currency holder 114 may be provided to retain coin and currency therein. In one form of the invention, the currency holder may include a currency/coin pocket 142 having a front wall 114 and a back wall (not shown) joined to each other along three edges 148 and resealably joined along a fourth edge 150 to allow containment of money therein, e.g. a coin purse. A checkbook 116 may be releasably mounted to the carrying case 16. In one form which may be used to releasably mount checkbook 116, a segment of plastic hook and loop tape 154, such as that sold under the trademark VELCRO, may be used. A calculator 120, a pair of scissors 122 and additional pockets 124 to hold credit cards may also be provided. Referring to FIG. 3, the scissors may be attached to the inside surface of the side wall 26 by a strap 160.

Referring to FIGS. 9 and 10, the coupon organizer 10 of the present invention may include a first and second sorter 18 and 20, respectively. Each sorter includes a sorter back wall 184 and has a plurality of sorting slots 186. In one embodiment, as best shown in FIG. 9, each sorting slot 186 is defined by a plurality of divider walls 190 pivotally mounted along a bottom edge 192 to the sorter back wall (not shown) to allow movement of the divider wall 190 outward relative to the back wall 184. For the purposes of illustration, the divider walls may be about four inches by about two inches. Each successive divider wall 190 when laid down substantially flush against the sorter back wall has non-overlapped portion 191 which extends beyond the top edge of the adjacent divider wall. In the preferred form, each successive divider wall extends about five-eighths of a inch beyond each successive adjacent divider wall. Mounted to these sorter divider walls 190 and extending outward therefrom are fourth identifying indicia means 200 for identification and finger manipulation of the desired sorting slot. The fourth indicia means 200 may include a tab 204 for insertion into a label member 206.

In an alternative embodiment, as shown in FIG. 10, the sorter divider walls 190 may be in the form of successively longer walls, having a top edge 202 extending the desired distance, e.g., by way of illustration, five-eighths of an inch, beyond each successive edge. In this form, a second plurality of concentric rings 207 may pivotally mount the divider walls to the sorter back wall. The first sorter 18 may be used to sort the coupons according to product type and thus may have, for example, about thirty sorting slots. The second sorter 20 may be used to sort the coupons according to expiration date and thus have a sufficient number of slots to correspond to the number of coupon pockets on each category pocket page, e.g. fourteen. As such, the first sorter may have a commensurately longer back wall 184 and an additional number of divider walls 190.

In operation the user will initially gather up all the coupons and place them into the unclipped coupon pocket 56. The first sorter 18 is removed from the case and is placed in front of the operator on a flat surface. The first and fourth indicia means 76 and 94, including for example, pre-printed color-coded category labels, are removed and torn apart at the desired perforations. Each pre-printed category label is placed at the side of each empty insert tab 76 or 200, respectively. The labels are preferably not inserted into the tabs at this time.

The operator then decides how the categories are to be labeled. While the merchandise categories are being selected and placed into the desired sequence, the operator should remember that the selected sequence will be the final means that will be used to "find" the coupons that he or she wishes to redeem. Those coupon categories which will be used more frequently should be placed at the front of the first sorter or sequence. When the operator has decided what category tabs 204 are going to be used and in what sequence they will be in, they are inserted into the appropriate empty label member 206 on the sorter 18.

In preparation for the next sorting step, the plurality of category pocket pages 71 are removed from the case 16. Using the completed first sorter 18 as a guide, the analagous first identifying indicia 74, e.g. matching pre-printed color-coded labels, are inserted into each empty first identifying indicia tab 76 located at the top edge 75 of each category pocket page 71. The sequence of first indicia label should match the order of fourth indicia or category labels in the first sorter 18. This allows for easier filing later. Alternatively, if the labels **96*b* are already affixed within the tabs 96*a*, the category pocket page 71 can be placed into the desired sequence by their removal and return to the attachment means 62**.

If not already so provided, the operator then matches the appropriate product index card 105 with the particular category of products to which the coupon pocket page 71 relates. This may be accomplished by removing a package of pre-printed category index cards 105 from the case 16 and inserting the appropriate category index card into the appropriate category index pocket 98. If needed, a hand-written description of the merchandise within the category may be placed upon a blank category index card.

If any initial set-up is required and has been performed by the operator he or she may discover that there are more categories than necessary. These unneeded category pages may then be removed from the filing assembly 12 of the present coupon organizing system invention 10. Additional category pocket pages 71, category index cards 105 and first and fourth identifying indicia 76 and 200, respectively, may be used to further break down each particular coupon category, e.g. "beverages" may be sub-divided into individual categories labeled coffee, tea, juice, soda, cocoa etc. Additional category pocket pages may be used to designate automotive products, drug store articles, video rentals, department store products and merchandise from different grocery store chains.

Using this process, the system is tailored to the individual operator and the coupon organizing system 10 of the present invention is ready for use. The operator may then remove the coupons from the unclipped coupon pocket 56. The scissors 122 are then used to clip the particular coupons being saved for redemption. By closely clipping the coupons, i.e., removing all extraneous material upon initial selection, the operator will eliminate unnecessary bulk. The coupons are stacked into a neat pile as they are clipped.

After all the coupons have been clipped, they are primarily sorted or inserted by the operator, one at a time, into the appropriate sorting slot 186 of the first sorter 18. This primary sorting may also be performed by conventional reading machinery which can according to a first criteria, e.g. product type, automatically sort printed matter according to the distinguishing symbols on the coupons. An example could be those used by the United States Post Office to machine sort mail according to zip codes.

If the operator does not have the time to finish sorting the clipped coupons, those already sorted may be left in the first sorter 18 and then into the unclipped coupon pocket 56. The stack of unsorted coupons may be placed behind the sorter. Using this method eliminates disorganized stacks lying about and frees the operator from the responsibility of remembering where the clipped coupons were placed. This also allows the operator to easily retrieve a particular coupon even if sorting has not been completed.

If, while the coupons are being primarily sorted by category, a coupon is for a product which does not necessarily correspond with those listed on particular category index card 105, the coupon may be held back for later sorting. For example, the operator may decide what the appropriate category should be and fill out the necessary information on a blank category index card.

After the coupons are organized according to the first criteria, e.g. product category, the operator removes the second sorter 20, e.g. that having the same number of slots 186 as the number of coupon pockets 78 in the category coupon page 71, e.g. fourteen. The coupons are then secondarily sorted according to a second criteria, e.g. expiration date. Only the first stack of coupons, i.e. those contained in the first slot 186 or designated category, is sorted into the appropriate slots of the second sorter. The operator is therefore sorting, according to expiration date, the coupons already sorted according to product or merchandise type. When sorting of a category is completed according to the expiration date, the corresponding coupon pocket page 71 is located and the coupons are inserted into the appropriate coupon pocket 78. If coupons are discovered which must be used almost immediately, they may be placed into the "use now" pocket **109*a***.

As described above, the present invention has three filing aids built into the coupon organizing system. First, the lip 90 of each coupon pocket 78 is thicker than the pocket back wall 84. Second, each pocket front wall 88 is substantially staggered or overlapping relative the pocket front wall 88, e.g. it has a shorter height relative to the corresponding back wall 84's dimension or successive divider walls may be positioned to have an unoverlapped portion extending beyond the previous divider wall's top edge 92. Third, the first and second identifying indicia tabs are easy to manipulate with the operator's fingers, aiding in the rapid retrieval of the desired coupon. These filing aids also provide for the easy transfer of the coupons into and out from each particular coupon pocket 78.

This filing procedure is repeated for each separate stack of coupons located in the category sorter, i.e. for each separate product type coupon is then placed onto one category pocket page for that product. Furthermore, upon each category pocket page, each pocket type is separated into separate temporal categories according to expiration dates. This places all the coupons of the same product on the same category page but further separates each product coupon temporally. The labeling or tabulation of the category pocket pages allows the operator to rapidly retrieve any desired product type, the operator merely manipulates the tab of the appropriate product type category pocket page then manipulates the tab of the desired expiration date pocket. By using this system, the operator, for any retrieval, need not redundantly scan through all the coupons he or she has, searching for the appropriate product coupon and checking the appropriate expiration dates. The operator will be able to tell at a glance which coupons are about to expire and can immediately dispose of expired coupon without further scanning. At the end of each month, the expired coupons which have not been redeemed may be disposed of. The coupons which had been filed in the pocket labeled "next year" may then be filed at any appropriate time and placed into the appropriate coupon pocket.

The new and improved food coupon organizing system of the present invention is extremely reliable and easy to use. The system provides for quick and easy reference to coupons for their redemption at any particular time. By using this invention, the operator now has the flexibility of pulling coupons for redemption at home while scanning the advertisements in the newspapers or retrieving the desired coupons at the store when needed. The system also sorts the coupons according to their expiration dates and prevents the embarassment of trying to use an expired coupon at the store.

While a particular form of the invention has been described, it will also be apparent to those skilled in the art, that various modifications can be made without departing from the scope of the invention. Accordingly, it is not intended that the invention be limited except as by the appended claims.

What is claimed is:

1. A coupon organizing system comprising:

a plurality of category pages, each said category page having a first wall, first indicia means extending outwardly from said first wall, and a plurality of substantially vertical overlapping divider walls mounted to said first wall to define a plurality of staggered pockets, said staggered pockets including means for facilitating insertion and withdrawal of coupons therefrom, wherein said means for facilitating insertion and withdrawal of coupons therefrom includes a lip formed in one of said walls;

a carrying case sized to receive said category pages, at least one of said category pages pivotally mounted to said carrying case; and attaching means for releasably attaching said plurality of category pages to said carrying case.

2. A coupon organizing system comprising:

a plurality of category pages, each said category page having a first wall, first indicia means extending outwardly from said first wall, and a plurality of substantially vertical overlapping divider walls mounted to said first wall to define a plurality of staggered pockets, said staggered pockets include means for facilitating insertion and withdrawal of coupons therefrom;

a carrying case sized to receive said category pages, at least one of said category pages pivotally mounted to said carrying case;

attaching means for releasably attaching said plurality of category pages to said carrying case; and a first and second sorter, each said sorter including a back wall and a second plurality of divider walls pivotally mounted about a long transverse axis to allow movement outward relative from a first position to a second position relative to said back wall.

3. A coupon organizing system comprising:

a plurality of category pocket pages, each said category pocket page having a first wall, first indicia means extending outwardly from said first wall, and a first plurality of substantially overlapping divider walls mounted to said first wall to define a plurality of substantially overlapping pockets;

a carrying case sized to receive said category pages;

a ringed binder, mounted to said carrying case, for releasably attaching said plurality of category pocket pages to said carrying case; and a sorter having a sorter back wall and a second plurality of adjacent divider walls, said second plurality of divider walls pivotally mounted to said sorter back wall and substantially overlapping said adjacent divider walls.

* * * * *